US006955418B2

(12) United States Patent
Ito

(10) Patent No.: US 6,955,418 B2
(45) Date of Patent: Oct. 18, 2005

(54) INK-JET PRINTHEAD

(75) Inventor: Atsushi Ito, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 117 days.

(21) Appl. No.: 10/461,779

(22) Filed: Jun. 12, 2003

(65) Prior Publication Data

US 2004/0001124 A1 Jan. 1, 2004

(30) Foreign Application Priority Data

Jun. 26, 2002 (JP) ..... 2002-185711

(51) Int. Cl.[7] ..... B41J 2/045

(52) U.S. Cl. ..... 347/68; 347/70; 347/71; 347/94

(58) Field of Search ..... 347/68, 70, 71, 347/94, 56

(56) References Cited

U.S. PATENT DOCUMENTS

| | | | | |
|---|---|---|---|---|
| 5,943,079 | A | 8/1999 | Yoshida | 347/94 |
| 2001/0020968 | A1 | 9/2001 | Isono et al. | 347/71 |

FOREIGN PATENT DOCUMENTS

| | | |
|---|---|---|
| EP | 0 963 846 A2 | 12/1999 |
| EP | 1 027 990 A1 | 8/2000 |
| EP | 1 093 919 A2 | 4/2001 |
| JP | 9314836 | 12/1997 |
| JP | 2002-36568 | 2/2002 |

*Primary Examiner*—Hai Pham
*Assistant Examiner*—Lam Nguyen
(74) *Attorney, Agent, or Firm*—Reed Smith LLP

(57) ABSTRACT

A cavity unit of an ink-jet printhead is formed by laminating a base plate formed with pressure chambers, a spacer plate, a manifold plate, a damper plate, a cover plate, and a nozzle plate formed with nozzles. The manifold plate is formed with a manifold chamber that penetrates through the manifold plate. The damper plate is formed with a recess on a side facing away from the manifold chamber and a damper wall left on a side facing the manifold chamber to have a partial thickness of the damper plate. The damper plate is bonded to the manifold plate on an opposite side from the base plate such that the damper wall is positioned to face the manifold chamber. The cover plate is bonded to the manifold plate to seal the recess. Because the damper plate is relatively thick while the damper wall is thin enough to absorb a pressure wave in the manifold chamber generated upon ink ejection, the damper plate is easy to handle.

25 Claims, 6 Drawing Sheets

INK-JET PRINTHEAD

BACKGROUND OF THE INVENTION

1. Field of Invention

The invention relates to a piezoelectric ink-jet printhead that has a cavity unit including a plate with a damper wall.

2. Description of Related Art

As disclosed in U.S. Pat. No. 5,943,079, which is incorporated herein by reference, a prior art on-demand type ink-jet printhead includes a cavity plate, a piezoelectric plate, and a vibration plate (flexible film) placed as a diaphragm between the cavity plate and the piezoelectric plate. The cavity plate is formed with nozzles, pressure chambers communicating with the respective nozzles, and an ink manifold that communicates with the pressure chambers to supply ink thereto. The piezoelectric plate is provided with energy generating portions, such as piezoelectric elements, that are selectively driven to pressurize the ink in the pressure chambers for ejection though the nozzles.

When any energy generating portion is driven, the corresponding pressure chamber is pressed and the pressure is transmitted to the corresponding nozzle, and an ink droplet is ejected from the nozzle to perform printing. When the pressure chamber is pressed, the pressure wave acting on the pressure chamber contains not only forward components directed toward the nozzle but also backward components simultaneously directed toward the ink manifold. As a result, so-called crosstalk between the forward and backward components may occur. To absorb and lessen the backward components, a damper is provided for the ink-jet printhead. A damper chamber is formed as a recess in the piezoelectric plate to face the ink manifold. The vibration plate (flexible film) extends to separate the damper chamber from the vibration plate (flexible film). A hole (air vent) is formed at a side of the piezoelectric plate (flexible film) at half the plate thickness such that the damper chamber communicates with the atmosphere.

However, the vibration plate (flexible film), which extends to separate the damper chamber from the ink manifold, can be used for only the structure where the pressure chamber and the ink manifold are arranged in the same plane of the cavity plate. In that structure, the energy generating portion and the damper chamber are also arranged in the same plane of the piezoelectric plate, and thus the width of the printhead in a direction perpendicular to the nozzle array becomes large. In addition, three-dimensional machining of the pressure chamber, ink manifold, and nozzles in the same cavity plate is difficult and requires many processes.

Another ink-jet printhead is disclosed in FIG. 4 of U.S. Patent Application Publication No. 2001/0020968, which is incorporated herein by reference in its entirety. A cavity unit of the ink-jet printhead is formed by laminating a plurality of plates, that is, a base plate formed with pressure chambers, a manifold plate formed with an ink manifold, a spacer plate interposed between the base plate and the manifold plate, and a nozzle plate formed with nozzles. In that structure, the width of the printhead in a direction perpendicular to the nozzle array can be reduced, and the pressure chambers, ink manifold, and nozzles can be machined easily in the respective plates. However, this structure does not allow a damper chamber to be formed to face the ink manifold in the manifold plate. If the manifold plate is made partially thin so as to be vibrated by a pressure wave, the rigidity of the printhead is partially reduced, and the ink ejection characteristics may vary among the nozzles.

SUMMARY OF THE INVENTION

The present invention addresses the foregoing problems and provides an ink-jet printhead that is rigid enough to stabilize the ink ejection characteristics of the nozzles and have a cavity unit that can effectively damp a pressure wave transmitted to the ink in a manifold chamber.

According to one aspect of the invention, an ink-jet printhead includes a cavity unit and an actuator having active portions and stacked on the cavity unit. The cavity unit has a plurality of nozzles and a plurality of pressure chambers arrayed in a line. Each pressure chamber communicates with a corresponding nozzle. The cavity unit also has a manifold plate and a damper plate. The manifold plate is formed with a manifold chamber that supplies ink to the plurality of pressure chambers. A depth of the manifold chamber is substantially equal to a thickness of the manifold plate. The damper plate is formed with a recess on a side facing away from the manifold chamber and a damper wall left on a side facing the manifold chamber to have a partial thickness of the damper plate. The recess has an outline shape that is substantially equal to or greater than an outline shape of the manifold chamber in the manifold plate in a plan view of the cavity unit. The active portions of the actuator are placed at the respective pressure chambers and are selectively driven to eject the ink in the pressure chambers through the nozzles.

According to another aspect of the invention, an ink-jet printhead includes a cavity unit and an actuator having active portions and stacked on the cavity unit. The cavity unit has a plurality of nozzles and a plurality of pressure chambers arrayed in a line. Each pressure chamber communicates with a corresponding nozzle. The cavity unit also has a manifold plate and a damper plate. The manifold plate is formed with a manifold chamber that supplies ink to the plurality of pressure chambers. A depth of the manifold chamber is substantially equal to a thickness of the manifold plate. The damper plate is formed with a recess on a side facing away from the manifold chamber and a damper wall left on a side facing the manifold chamber to have a partial thickness of the damper plate. The damper plate is bonded to the manifold plate on an opposite side from the pressure chambers such that the damper wall faces the manifold chamber. The active portions of the actuator are placed at the respective pressure chambers and are selectively driven to eject the ink in the pressure chambers through the nozzles.

According to another aspect of the invention, an ink-jet printhead includes an actuator having active portions and a cavity unit bonded to the actuator. The cavity unit has a base plate, a manifold plate, a spacer plat, and a camper plate. The base plate is formed with an array of pressure chambers that extends in a first direction parallel to a plane of the base plate. The pressure chambers face the respective active portions of the actuator. The manifold plate is formed with a manifold chamber that extends in the first direction to partially overlap the array of pressure chambers and supplies ink to the pressure chambers. The spacer plate is interposed between the base plate and the manifold plate. The damper plate is disposed adjacent to the manifold plate and has a damper wall that is formed to overlap the manifold chamber by recessing the damper plate from a side away from the manifold plate to leave a partial thickness of the damper plate.

BRIEF DESCRIPTION OF THE DRAWINGS

A preferred embodiment of the invention will be described in detail with reference to the following figures, in which like elements are labeled with like numbers and in which.

DETAILED DESCRIPTION OF PREFERRED EMBODIMENT

Figure 1:
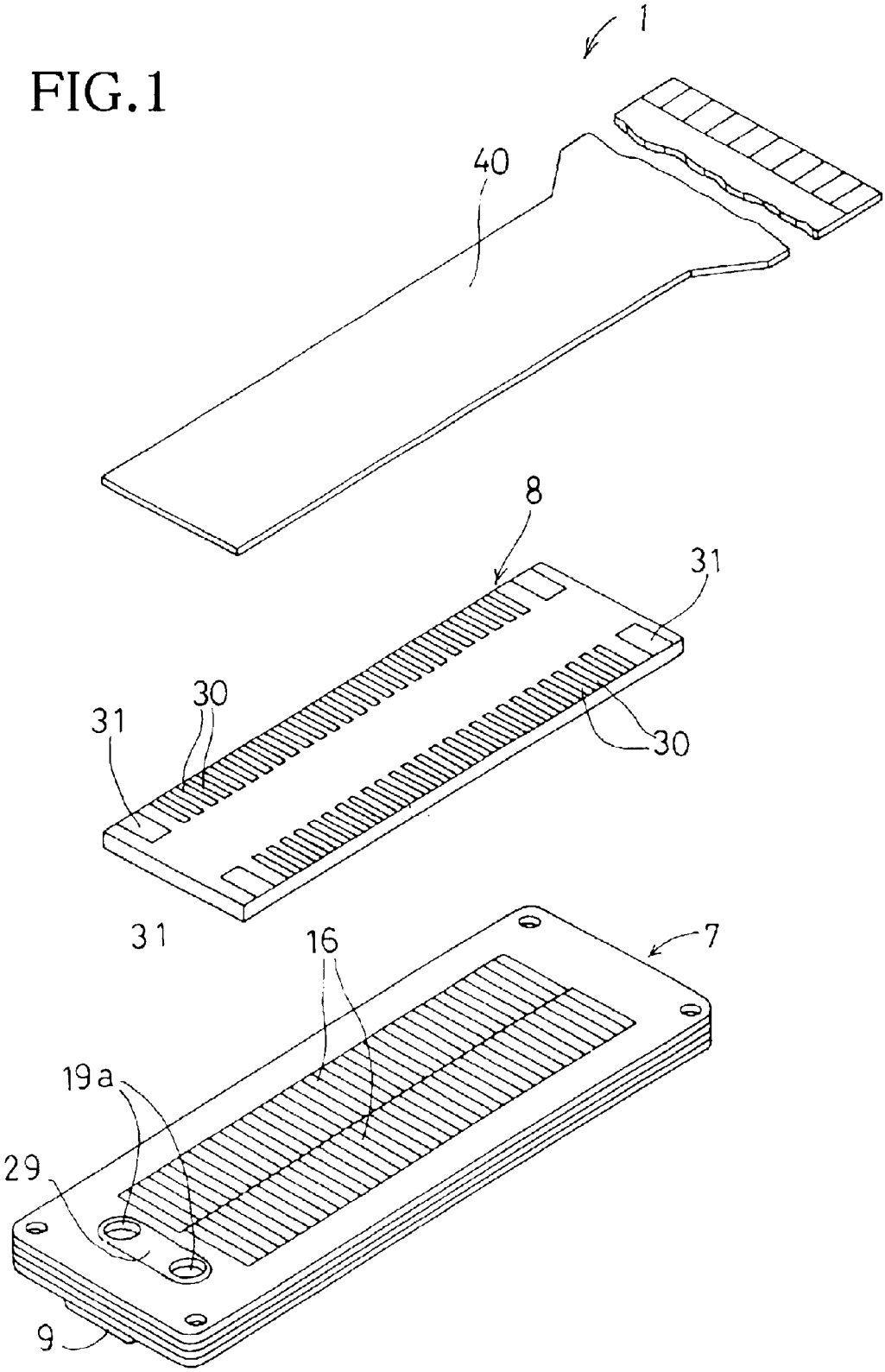
FIG. 1 is an exploded perspective view of a piezoelectric ink-jet printhead according to one embodiment of the invention.

An ink-jet printhead 1 according to one embodiment of the invention will be described with reference to FIGS. 1 through 4. In the ink-jet printhead 1, a flexible flat cable 40 is bonded to an upper surface of a plate-shaped piezoelectric actuator 8 for connection with external devices, and the piezoelectric actuator 8 is bonded to a cavity unit 7. Ink is ejected from nozzles open at a lower surface of the cavity unit 7.

The structure of the cavity unit 7 will be described with reference to FIGS. 2 and 3. The cavity unit 7 is formed by laminating and bonding seven thin plates, that is, a nozzle plate 9, a cover plate 10, a damper plate 11, two manifold plates 12, 12, a spacer plate 13, and a base plate 14. In this embodiment, each plate 10, 11, 12, 12, 13, 14, except for the nozzle plate 9, is made of 42% nickel steel and has a thickness of about 50–150 $\mu$m. Openings and recesses are formed as ink passages and chambers, which will be described later, in these plates by electrolytic etching, laser machining, plasma jet machining, or other methods. A plurality of nozzles 15 having a very small diameter (about 25 $\mu$m) are formed for ink ejection in the nozzle plate 9 in a first direction (longitudinal direction) in two rows in a staggered configuration. These nozzles 15 are arranged with a very small pitch P, along two reference lines 9*a*, 9*b* of the nozzle plate 9 that extend parallel to the first direction.

Figure 3:
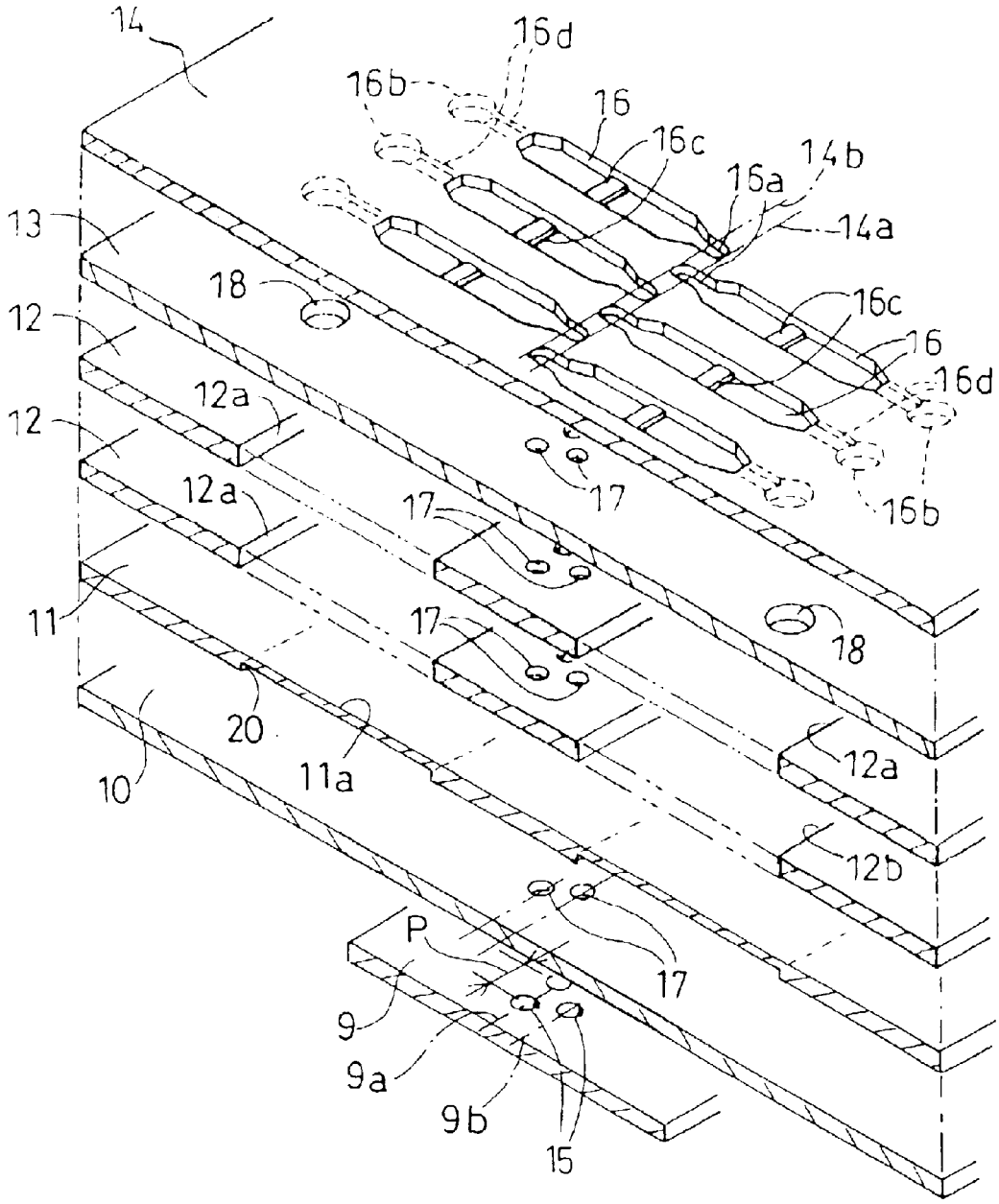
FIG. 3 is an enlarged partial perspective view of the cavity unit.
Figure 4:
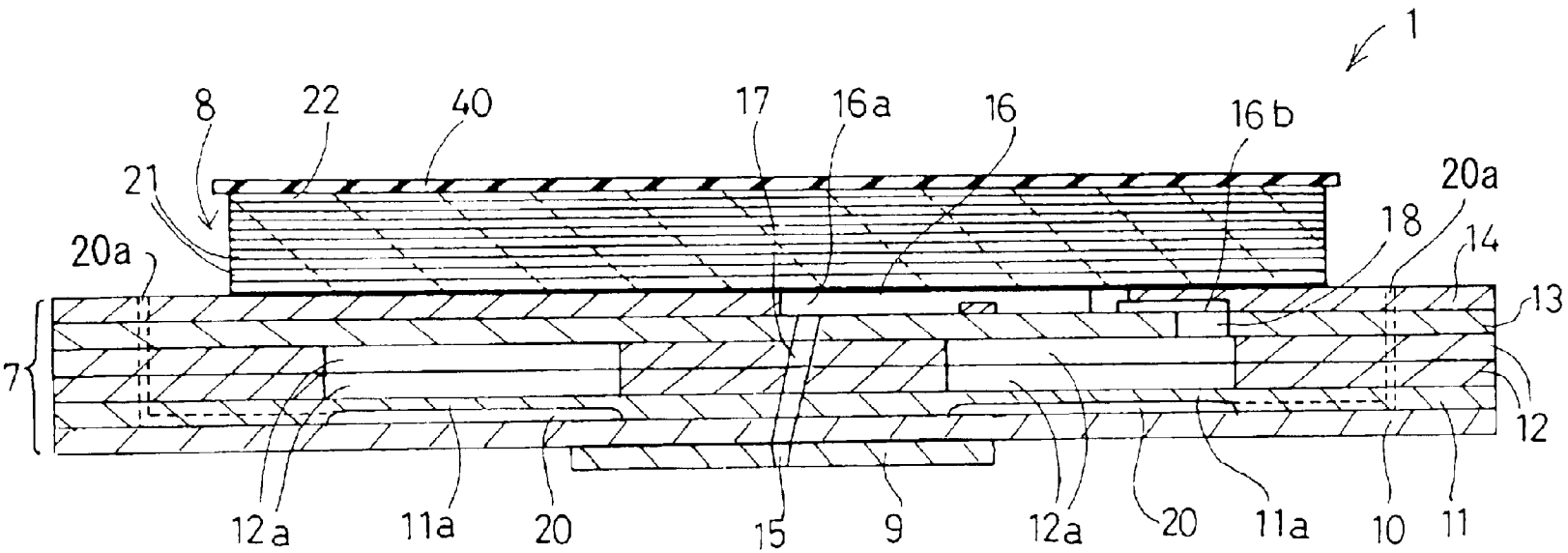
FIG. 4 is an enlarged sectional view of the piezoelectric ink-jet printhead.
Figure 5:
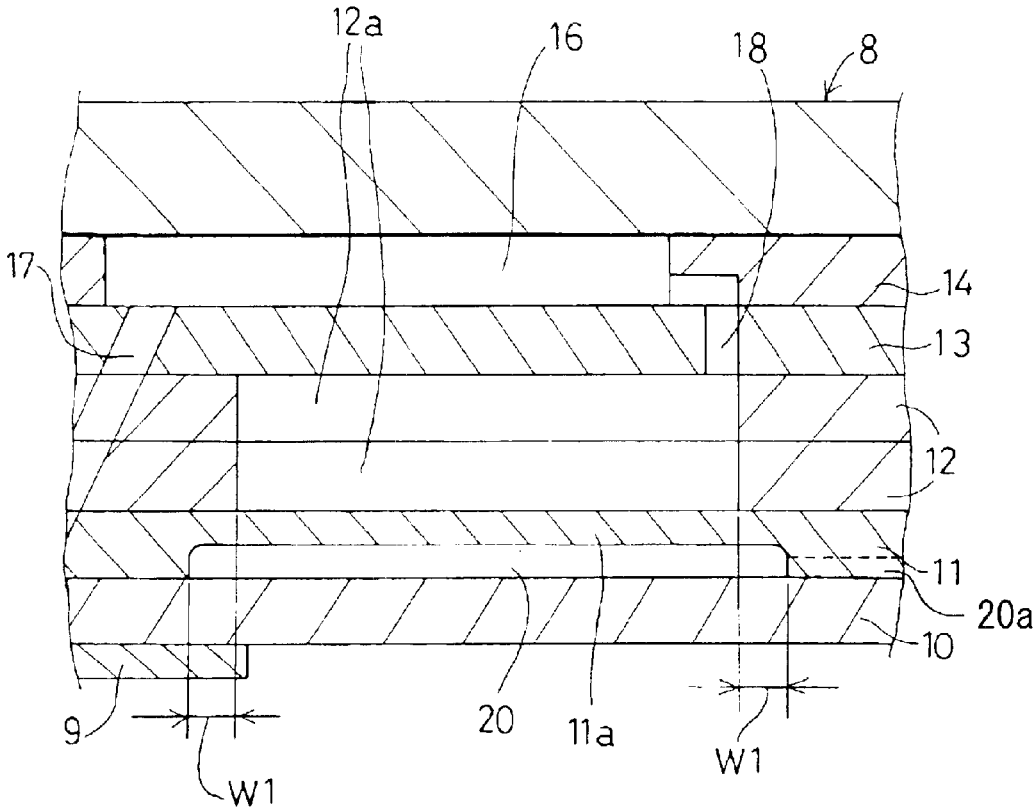
FIG. 5 is an enlarged partial sectional view of the cavity unit.

A plurality of pressure chambers 16 communicating with the respective nozzles 15 vertically overlap active portions formed by piezoelectric elements of the piezoelectric actuator 8 in the plan view of the plates of the cavity unit 7. Each pressure chamber 16 extends perpendicularly to the first direction and an array of pressure chambers 16 extends along the first direction. A pair of manifold chambers 12*a*, 12*a* are formed as ink passages in each of the two manifold plates 12, 12 to extend on both sides of the nozzle arrays. In this case, as shown in FIGS. 3 and 4, a pair of manifold chambers 12*a*, 12*a* are formed through each of the two manifold plates 12, 12 to have a depth substantially equal to the thickness of the manifold plate 12. Each manifold chamber 12*a* is shaped to partially overlap and extend along an array of pressure chambers 16 in the plan view.

The damper plate 11 is formed with a pair of recesses (damper chambers) 20, 20 open toward the cover plate 10 that underlies the damper plate 11 while leaving thin top portions (damper walls) 11*a* on the upper side of the damper plate 11. Each recess (damper chamber) 20 has substantially the same shape, in the plan view, as the shape of the manifold chamber 12*a*.

Accordingly, as shown in FIG. 4, the manifold chambers 12*a*, 12*a* are sealed by bonding the lower surface of the spacer plate 13 and the upper surface of the upper manifold plate 12 and by bonding the lower surface of the lower manifold plate 12 and the upper surface of the damper plate 11. The recesses (damper chambers) 20, 20 are sealed by bonding the cover plate 10 to the damper plate 11.

A plurality of pressure chambers 16 are formed in the base plate 14 such that each narrow pressure chamber 16 is narrow and extends in a second direction (lateral direction), perpendicularly to the center line that is parallel to the first (longitudinal) direction. End portions 16*a* of the pressure chambers 16 located on the left side in FIG. 3 are aligned with the right reference line 14*a* while end portions 16*a* of the pressure chambers 16 located on the right side are aligned with the left reference line 14*b*. The end portions 16*a* of the pressure chambers 16 on the right and left sides are arranged alternately, and the pressure chambers 16 extend in opposite directions, alternately.

The end portions 16*a* of the pressure chambers 16 communicate with the nozzles 15 formed in the nozzle plate 9 in a staggered configuration via small-diameter through-holes 17 formed in the spacer plate 13, manifold plates 12, 12, damper plate 11, and the cover plate 10. The through-holes 17 have a very small diameter and serve as ink passages. Other end portions 16*b* of the pressure chambers 16 communicate with the manifold chambers 12*a*, 12*a* on either side of the manifold plates 12 via through-holes 18 formed at lateral ends of the spacer plate 13. As shown in FIG. 3, the end portions 16*b* and the narrow restricting portions 16*d* are recessed and open at only a lower surface of the base plate 14. The end portions 16*b* have substantially the same diameter as the through-holes 18. The restricting portions 16*d* have a sectional area smaller than the pressure chambers 16 to prevent the ink from flowing back from the pressure chambers 16 to the manifold chambers 12*a*, 12*a* when the piezoelectric actuator 20 is driven.

A thin bridge 16*c* is formed by half-etching or other methods in the middle of each pressure chamber 16 with respect to the longitudinal direction to maintain the rigidity of the narrow partition wall between adjacent pressure chambers 16. In addition, as shown in FIG. 1, a filter 29 is provided over the supply holes 19*a*, 19*a* formed at one end of the topmost base plate 14 to remove foreign substances from the ink supplied from an ink tank (not shown) disposed above the ink-jet printhead.

Figure 2:
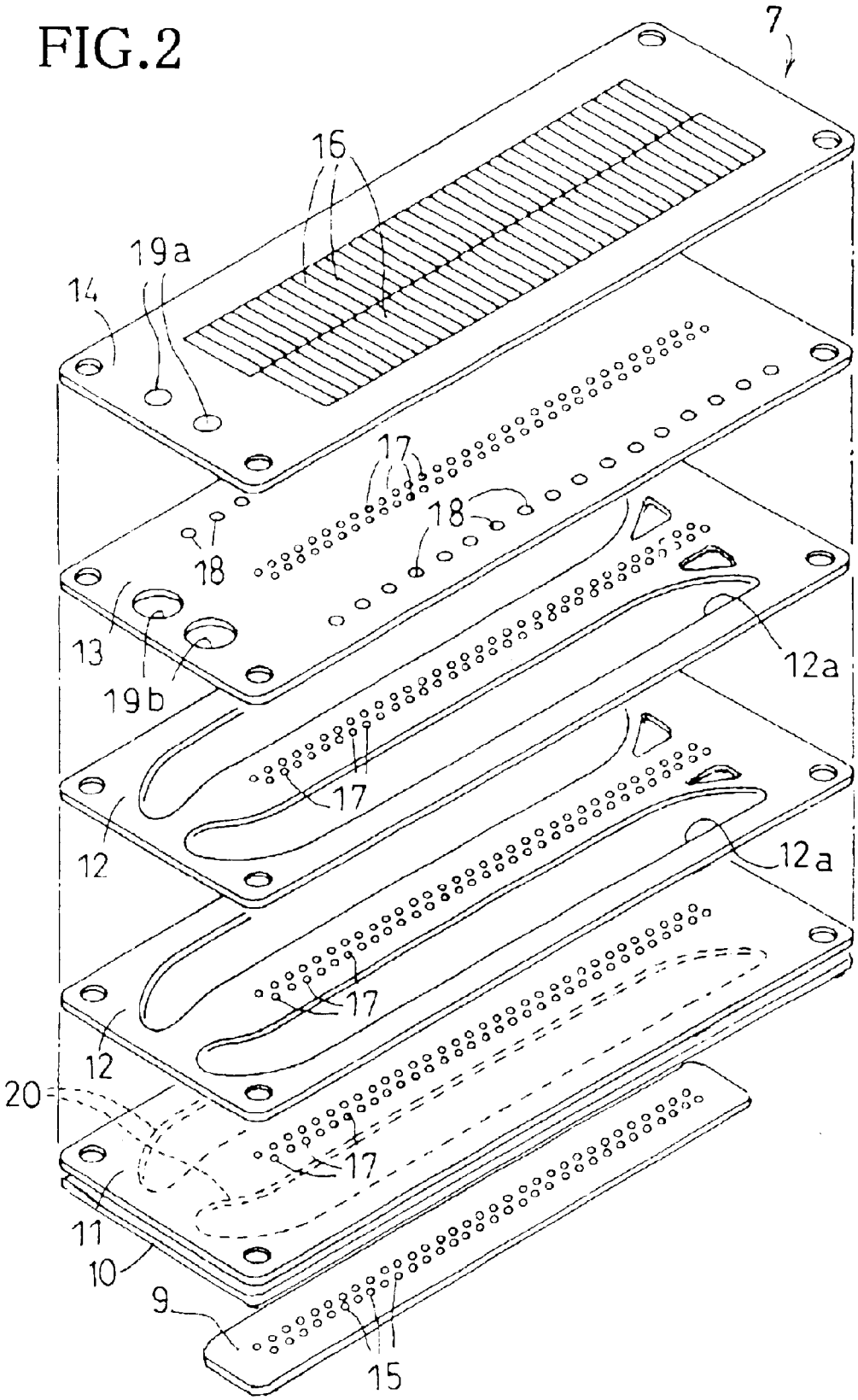
FIG. 2 is an exploded perspective view of a cavity unit of the piezoelectric ink-jet printhead.

As shown in FIGS. 2 and 4, the ink passes through the supply holes 19*a*, 19*b* formed at one side of the base plate 14 and the spacer plate 13 and flows into the manifold chambers 12*a*, 12*a* formed on the lateral sides of the manifold plates 12, 12. The ink further passes through the through-holes 18 and is distributed to the pressure chambers 16. The ink in the ink chambers 16 flows through the through-holes 17 and reaches the nozzles 15.

Similar to a piezoelectric actuator disclosed in Japanese Laid-Open Patent Publication No. 2002-36568, which is incorporated herein by reference, the piezoelectric actuator 8 is formed, as shown in FIG. 4, by laminating a plurality of piezoelectric ceramic sheets 21, each having a thickness of 30 $\mu$m. In addition, a top sheet 22 is placed at the top. Narrow individual electrodes (not shown) are printed on the upper surface (wide surface) of each of the lowermost sheet 21 and the odd-numbered sheets 21 counting from the lowermost sheet 21, along the first direction (longitudinal direction) of the piezoelectric sheets 21, in two arrays at positions corresponding to the pressure chambers 16 in the cavity unit 7. Each individual electrode extends in the second direction (lateral direction) perpendicular to the first direction and nearly up to the longitudinal edge of the piezoelectric sheet 21. A common electrode (not shown) common to the pressure chambers 16 is formed on the upper surface (wide surface) of each of the even-numbered sheets 21 counting from the lowermost sheet 21. In this case, end faces of the individual electrodes and end faces of lead-out portions of the common electrodes are exposed to longitudinal edges of each piezoelectric sheet 21.

On the upper surface of the top sheet 22, as shown in FIG. 1, surface electrodes 30 are printed to correspond to the individual electrodes, and surface electrodes 31 are printed to correspond to lead-out portions of the common electrodes. Then, side electrodes are formed such that each surface electrode 30 and corresponding individual electrodes, which are vertically aligned, are electrically connected at their exposed end faces. Likewise, side electrodes are formed such that each surface electrode 31 and corresponding lead-out portions of the common electrodes, which are vertically aligned, are electrically connected at their exposed end faces.

As shown in FIG. 4, the piezoelectric actuator 8 shaped like a plate and structured as described above is stacked on and fixed to the cavity unit 7 such that each individual electrode of the piezoelectric actuator 8 is placed at a corresponding pressure chamber 16. The flexible flat cable 40 is stacked on and bonded to the upper surface of the piezoelectric actuator 8, thereby electrically connecting various wiring patterns (not shown) of the flexible flat cable 40 to the surface electrodes 30, 31.

In the ink-jet printhead structured as described above, when a drive voltage is applied selectively between the vertically aligned individual electrodes and the common electrodes in the piezoelectric actuator 8, segments between the vertically aligned individual electrodes and the common electrodes deform as an active portion by piezoelectric effect in the laminating direction of the piezoelectric ceramic sheets 21. By the deformation of an active portion, the corresponding pressure chamber 16 is pressurized and the pressure is transmitted to the corresponding nozzle 15, and an ink droplet is ejected from the nozzle 15 to perform printing.

When the pressure chamber is pressurized, a pressure wave acting on the pressure chamber 16 contains forward components directed toward the nozzle 15 and simultaneous backward components directed toward the manifold chamber 12*a*. The backward components are reflected at the manifold chamber 12*a* and directed to the nozzle 15 following the forward components. The reflected wave in the manifold chamber 12*a* is dispersed to the pressure chambers 16 because the manifold chamber 12*a* is common to the pressure chambers 16. Although the reflected wave alone may not cause ink ejection, the reflected wave may affect replenishment of the ink after ejection by the forward wave and change the amount of ink in the ink chambers 16 and the ejection speed for the next ink ejection. Because the degree of such effect depends on the number of pressure chambers 16 driven at the same time, the amount of ink and the ejection speed may vary for each ink ejection, resulting in a degradation in print quality.

The thin top portion (damper wall) 11*a* (FIG. 4) between the manifold chamber 12*a* and the damper chamber 20 is greatly vibrated by the backward components, thereby effectively absorbing the backward components in the manifold chamber 12*a*. Thus, the above-described crosstalk between the forward and backward components is prevented. The backward components of the pressure wave may be absorbed by elastic vibration of the top portion (damper wall) 11*a* alone, or by a combination of the top portion 11*a* and the air in the damper chamber 20.

Figure 6:
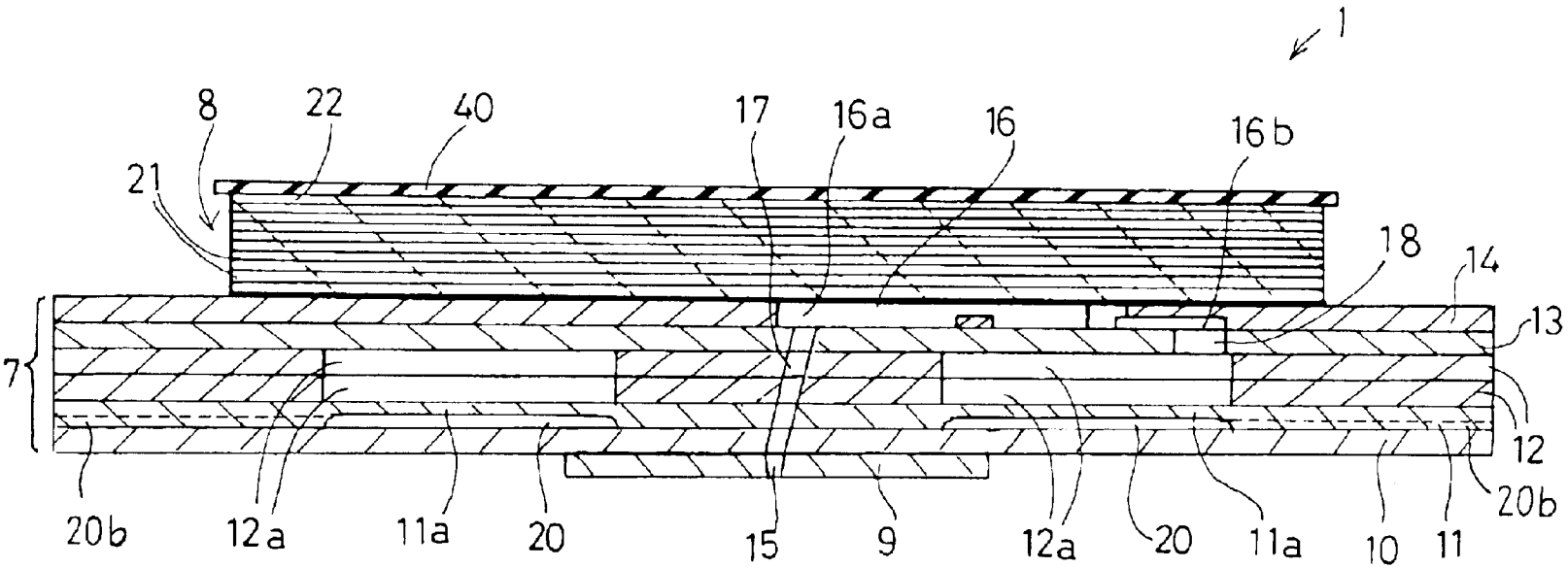
FIG. 6 is an enlarged sectional view of the piezoelectric ink-jet printhead having a cavity unit formed with a communication hole open at its one end.

The cover plate 10, which covers the lower surface of the damper plate 11 formed with the damper chamber 20, has a uniform thickness and is rigid enough to withstand the pressure from a nozzle cap (not shown). The nozzle cap is used to cover the nozzles 15 while pressing the nozzle plate 9, which underlies the cover plate 10, toward the manifold plates 12 when the ink-jet printhead is in the rest position. Thus, the cover plate 10 prevents, by its rigidity, the damper plate 11 and the manifold plates 12 from warping. Because the capacity of the damper chamber 20 remains unchanged, the ink ejection characteristics are not affected. Also, because the nozzle plate 9 is prevented from warping and the directions of the nozzles remain unchanged, print quality is not degraded. It is preferable that, as shown in FIG. 4, the damper chamber 20 communicates with the atmosphere through a small-diameter communication hole 20*a* that is formed from the damper chamber 20 to be open at the upper surface of the cavity unit 7. Alternately, as shown in FIG. 6, a communication hole 20*b* may be formed to be open at an end portion of the damper plate 11. The air in the damper chamber 20 communicating with the atmosphere is kept at a uniform pressure, and this allows the damper chamber 20 to absorb the pressure wave effectively and prevent the crosstalk.

Further, it is preferable that the damper chamber 20 is slightly greater by a dimension of W1, in width and length, than the manifold plates 12 such that the outline shape of the damper chamber 20 encloses the outline shape of the manifold chamber 12*a* in the plan view. With this structure, the manifold 12*a* is kept enclosed by the top portion (damper wall) 11*a* of the damper chamber 20, and the damping effect of the top portion 11*a* is maximized. When the pressure wave generated in the manifold chamber upon the ejection of ink acts on the damper wall 11*a*, the damper wall 11*a* having a thin thickness can be elastically bent entirely across the manifold chamber in the plan view. In addition, even when the manifold plate 12 and the damper plate 11 are positionally shifted from each other by a certain amount during bonding, the manifold chamber 12*a* is likely to be placed within the outline shape of the recess 11*a*, and the damping effect is not degraded.

In the ink-jet printhead according to the above-described embodiment, the cavity unit 7 is formed by laminating a plurality of plates, including the manifold plate 12 and the damper plate 11 that are adjacent to each other. The manifold plate 12 is formed with the manifold chambers 12*a* that supply the ink to the pressure chambers 16, and the damper plate 11 is formed with the damper walls 11*a* that are aligned with the manifold chambers 12*a*. The manifold chamber 12*a* is formed to have a depth equal to the thickness of the manifold plate 12. The damper plate 11 is recessed from the opposite side from the manifold chamber 12*a* and a portion having a partial thickness of the damper plate 11 is disposed on the side facing the manifold chamber 12*a*, as the damper wall 11*a* that absorbs and lessens the pressure wave transmitted to the ink in the manifold chamber 12*a* upon ink ejection. Thus, there is no need to provide a separate thin vibration film. Because the damper plate 11 is relatively thick while the damper wall 11*a* is thin enough to be deformable by the pressure wave, the damper plate 11 is easy to handle. Further, the manifold chamber 12*a* is formed accurately in depth.

Whereas, in the above-described embodiment, the two manifold plates 12 are stacked, a single relatively thick manifold plate may be used, or three or four relatively thin manifold plates may be used, instead.

Whereas, in the above-described embodiment, a single-piece actuator having active portions that activate the pressure chambers is used, individual piezoelectric elements may be placed at the respective pressure chambers, or other types of actuators may be used.

While the invention has been described with reference to the specific embodiment, the description of the embodiment is illustrative only and is not to be construed as limiting the scope of the invention. Various other modifications and changes may be possible to those skilled in the art without departing from the spirit and scope of the invention.

What is claimed is:

1. An ink-jet printhead comprising:

a cavity unit including:

a plurality of nozzles;

a plurality of pressure chambers arrayed in a line, each pressure chamber communicating with a corresponding nozzle;

a manifold plate formed with a manifold chamber that supplies ink to the plurality of pressure chambers, a depth of the manifold chamber being substantially equal to a thickness of the manifold plate; and a damper plate formed with a recess on a side facing away from the manifold chamber and a damper wall disposed on a side facing the manifold chamber to have a partial thickness of the damper plate, the recess having an outline shape that is substantially equal to or greater than an outline shape of the manifold chamber in the manifold plate in a plan view of the cavity unit; and an actuator stacked on the cavity unit and having active portions placed at the respective pressure chambers and selectively driven to eject the ink in the pressure chambers through the nozzles, wherein the cavity unit further includes a cover plate that is bonded to the damper plate to seal the recess in the damper plate and the nozzles are formed in a nozzle plate and the nozzle plate is bonded to the cover plate.

2. The ink-jet printhead according to claim 1, wherein the damper plate is bonded to the manifold plate on an opposite side from the pressure chambers such that the damper wall faces the manifold chamber.

3. The ink-jet printhead according to claim 1, wherein the pressure chambers are formed in a pressure chamber plate, and the cavity unit further includes a spacer plate disposed between the pressure chamber plate and the manifold plate, the spacer plate being formed with supply holes through which the ink flows from the manifold chamber to the pressure chambers.

4. The ink-jet printhead according to claim 3, wherein the plurality of pressure chambers communicate with the respective nozzles through through-holes formed in the spacer plate, the manifold plate, the damper plate, and the cover plate.

5. The ink-jet printhead according to claim 3, wherein the recess in the damper plate communicates with atmosphere through a hole formed through the manifold plate, the spacer plate, and the pressure chamber plate.

6. The ink-jet printhead according to claim 1, wherein the active portions are selectively driven to cause a pressure wave in the ink in the pressure chambers, part of the pressure wave is directed from the pressure chambers to the manifold chamber and vibrates the damper wall.

7. The ink-jet printhead according to claim 1, wherein the recess in the damper plate communicates with atmosphere through a hole open at one end of the damper plate.

8. The ink-jet printhead according to claim 1, wherein the cavity unit further includes a second manifold plate that is identical with the manifold plate, the second manifold plate being bonded to the manifold plate.

9. An ink-jet printhead comprising:

a cavity unit including:

a plurality of nozzles;

a plurality of pressure chambers arrayed in a line, each pressure chamber communicating with a corresponding nozzle;

a manifold plate formed with a manifold chamber that supplies ink to the plurality of pressure chambers, a depth of the manifold chamber being substantially equal to a thickness of the manifold plate; and a damper plate formed with a recess on a side facing away from the manifold chamber and a damper wall disposed on a side facing the manifold chamber to have a partial thickness of the damper plate, the damper plate being bonded to the manifold plate on an opposite side from the pressure chambers such that the damper wall faces the manifold chamber; and an actuator stacked on the cavity unit and having active portions placed at the respective pressure chambers and selectively driven to eject the ink in the pressure chambers through the nozzles, wherein the cavity unit further includes a cover plate that is bonded to the damper plate to seal the recess in the damper plate and the nozzles are formed in a nozzle plate and the nozzle plate is bonded to the cover plate.

10. The ink-jet printhead according to claim 9, wherein the recess has an outline shape that is substantially equal to or greater than an outline shape of the manifold chamber in the manifold plate in a plan view of the cavity unit.

11. The ink-jet printhead according to claim 9, wherein the pressure chambers are formed in a pressure chamber plate, and the cavity unit further includes a spacer plate disposed between the pressure chamber plate and the manifold plate, the manifold chamber penetrating through the manifold plate in its thickness direction and the damper wall being flush with a manifold plate-facing surface of the damper plate.

12. The ink-jet printhead according to claim 11, wherein the plurality of pressure chambers communicate with the respective nozzles through through-holes formed in the spacer plate, the manifold plate, the damper plate, and the cover plate.

13. The ink-jet printhead according to claim 11, wherein the recess in the damper plate communicates with atmosphere through a hole formed through the manifold plate, the spacer plate, and the pressure chamber plate.

14. The ink-jet printhead according to claim 9, wherein when the active portions are selectively driven to cause a pressure wave in the ink in the pressure chambers, part of the pressure wave is directed from the pressure chambers to the manifold chamber and vibrates the damper wall.

15. The ink-jet printhead according to claim 9, wherein the recess in the damper plate communicates with atmosphere through a hole open at one end of the damper plate.

16. The ink-jet printhead according to claim 9, wherein the cavity unit further includes a second manifold plate that is identical with the manifold plate, the second manifold plate being bonded to the manifold plate.

17. An ink-jet printhead, comprising:

an actuator having active portions; and a cavity unit bonded to the actuator including:

a base plate formed with an array of pressure chambers that extends in a first direction parallel to a plane of the base plate, the pressure chambers facing the respective active portions of the actuator;

a manifold plate formed with a manifold chamber that extends in the first direction to partially overlap the array of pressure chambers and supplies ink to the pressure chambers;

a spacer plate interposed between the base plate and the manifold plate; and a damper plate disposed adjacent to the manifold plate and having a damper wall that is formed to overlap the manifold chamber by recessing the damper plate from a side away from the manifold plate to leave a partial thickness of the damper plate, wherein the cavity unit further includes a nozzle plate formed with nozzles that communicate with respective pressure chambers and a cover plate interposed between the damper plate and the nozzle plate.

18. The ink-jet printhead according to claim 17, wherein the damper wall is substantially equal to or greater, in length in the first direction and in width perpendicular to the first direction, than the manifold chamber by a predetermined dimension.

19. The ink-jet printhead according to claim 17, wherein the manifold chamber penetrates through the manifold plate in its thickness direction, and the damper wall is flush with a manifold plate-facing surface of the damper plate.

20. An ink-jet printhead comprising:

a cavity unit including:

a plurality of nozzles spaced apart from each other;

a plurality of pressure chambers each storing ink and communicating with a corresponding nozzle;

a manifold plate underlying the plurality of pressure chambers and having a manifold chamber that supplies the ink to the pressure chambers; and a damper plate having a damper wall underlying the manifold chamber and a recess underlying the damper wall, the damper wall operable to absorb a backward pressure wave coming from the pressure chambers; and an actuator overlying the cavity unit and operable to selectively pressurize the ink in the pressure chambers for ejection through the nozzles, wherein the cavity unit includes a cover plate that is bonded to the damper plate to seal the recess in the damper plate and the nozzles are formed in the nozzle plate and the nozzle plate is bonded to the cover plate.

21. The ink-jet printhead according to claim 20, wherein the recess has an outline shape that is substantially equal to or greater than an outline shape of the manifold chamber in the manifold plate.

22. The ink-jet printhead according to claim 20, wherein the selective pressurization of the pressure chambers by the actuator causes the backward pressure wave in the ink in the pressure chambers and the damper wall vibrates to absorb the backward pressure wave coming from the pressure chambers to the manifold chamber.

23. The ink-jet printhead according to claim 20, wherein the manifold plate includes a hole through which the recess in the damper plate communicates with atmosphere.

24. The ink-jet printhead according to claim 20, wherein the damper plate includes a hole open at one end of the damper plate through which the recess in the damper plate communicates with atmosphere.

25. The ink-jet printhead according to claim 20, wherein the manifold plate includes at least two substantially identical plates bonded to each other.

* * * * *